US006823166B2

(12) United States Patent
Nishiwaki

(10) Patent No.: US 6,823,166 B2
(45) Date of Patent: Nov. 23, 2004

(54) IMAGE BEARING APPARATUS THAT COLLECTS IMAGE BEARING BODIES AT A COMMON PLACE

(75) Inventor: Kenjiro Nishiwaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/368,407

(22) Filed: Feb. 20, 2003

(65) Prior Publication Data

US 2003/0161652 A1 Aug. 28, 2003

(30) Foreign Application Priority Data

Feb. 22, 2002 (JP) ..... 2002-046561

(51) Int. Cl.[7] ..... G03G 21/00; G03G 15/16

(52) U.S. Cl. ..... 399/343; 399/101; 399/302; 399/313; 399/345

(58) Field of Search ..... 399/302, 308, 399/313, 343, 345, 349, 101

(56) References Cited

U.S. PATENT DOCUMENTS 4,899,198 A * 2/1990 Mahoney ..... 399/302
5,079,592 A * 1/1992 Kanis ..... 399/302
2001/0043825 A1 * 11/2001 Kim ..... 399/313

FOREIGN PATENT DOCUMENTS

| | | | |
|---|---|---|---|
| JP | A 63-68871 | 3/1988 | |
| JP | A 3-220571 | 9/1991 | |
| JP | A 4-184473 | 7/1992 | |
| JP | A 8-30163 | 2/1996 | |
| JP | A 8-254934 | 10/1996 | |
| JP | A 11-7226 | 1/1999 | |
| JP | A 2000-3117 | 1/2000 | |
| JP | A 2001-5360 | 1/2001 | |
| JP | A 2001-75374 | 3/2001 | |
| JP | 2003186364 A * | 7/2003 | ..... G03G/21/10 |

* cited by examiner

*Primary Examiner*—Susan Lee
(74) *Attorney, Agent, or Firm*—Oliff & Berridge, PLC

(57) ABSTRACT

A photosensitive belt cleaning roller is constructed to discharge residual toner, removed from a photosensitive belt onto an intermediate transferring belt. Accordingly, the residual toner on the photosensitive belt is first removed by the photosensitive belt cleaning roller, is discharged from the photosensitive belt cleaning roller onto the intermediate transferring belt, and is then finally removed from the intermediate transferring belt by the intermediate transferring belt cleaning unit. Accordingly, it is possible to efficiently collect residual toner remaining on the first and second image bearing bodies into a single, common place.

19 Claims, 7 Drawing Sheets

IMAGE BEARING APPARATUS THAT COLLECTS IMAGE BEARING BODIES AT A COMMON PLACE

BACKGROUND OF THE INVENTION

1. Field of the Invention

The present invention relates to an image forming apparatus of a type that includes a plurality of image bearing bodies.

2. Description of Related Art

As an example of the image forming apparatus of this type, there has conventionally been known an image forming apparatus that includes: a photosensitive member, a plurality of developing devices, and an intermediate transferring member. The plurality of developing devices contain toner in a plurality of different colors, respectively. Each developing device includes a developing roller. The photo 16 member (image bearing body) bears visible images in respective colors, which have been developed by toner supplied from the developing rollers. The visible images in the respective colors are transferred to the intermediate transferring member (another image bearing body) and are superimposed one on another on the intermediate transferring member. In this way, the intermediate transferring member bears a resultant multi-color image. The multicolor image is then transferred from the intermediate transferring member onto a sheet. The representative examples of the photosensitive member include a photosensitive drum and a photosensitive belt.

A cleaning device is ordinarily provided in such a type of color laser printer. The cleaning device removes, from the photosensitive member, residual toner that remains on the photosensitive member after the visible images are transferred from the photosensitive member onto the intermediate transferring member. An additional cleaning apparatus is provided for removing, from the intermediate transferring member, residual toner that remains on the intermediate transferring member after the color image is transferred from the intermediate transferring member onto the sheet.

In one example, a photosensitive-member cleaning roller is provided to contact the surface of the photosensitive member. Waste toner captured by the surface of the photosensitive member cleaning roller is accumulated in a waste toner reserving portion that is provided in proximity to the photosensitive-member cleaning roller. An intermediate-transferring-member cleaning roller is additionally provided to contact the surface of the intermediate transferring member. Waste toner captured by the surface of the intermediate-transferring-member cleaning roller is accumulated in another water toner reserving portion that is provided in proximity to the intermediate-transferring-member cleaning roller.

In this way, two waste toner cases are provided in the color laser printer. However, in such a case, it becomes difficult to reduce the size of the entire apparatus. It is required to perform a cumbersome maintenance work such as discharging of toner accumulated in the two different waste toner cases.

In view of these problems, there has been proposed a method for first returning the toner captured by the surface of the photosensitive-member cleaning roller back to the photosensitive member at a timing other than the period, during which image forming operations is performed on the photosensitive member. Then, the waste toner is transferred from the photosensitive member onto the intermediate transferring member. Following this, the waste toner that is now on the intermediate transferring member is captured by the intermediate-transferring-member cleaning roller and is collected in a waste toner reserving portion that is provided in proximity to the intermediate-transferring-member cleaning roller. With this method, it becomes possible to collect the waste toner at one place. It becomes relatively easy to reduce the size of the apparatus. The maintenance work becomes easier.

SUMMARY OF THE INVENTION

With the above-described conventional method, the toner captured by the photosensitive member cleaning roller is carried to the waste toner reserving portion through the photosensitive member and the intermediate transferring member. Accordingly, the photosensitive member will possibly be stained with the waste toner.

Additionally, the transferring ratio of toner from the photosensitive member to the intermediate transferring member is not always 100%. In other words, the entire amount of toner on the photosensitive-member may not be completely transferred from the photosensitive member to the intermediate transferring member. Accordingly, the waste toner may not be collected with high recovery efficiency.

In view of the above-described drawbacks, it is an objective of the present invention to provide an improved image forming apparatus that includes a plurality of image bearing bodies and that can efficiently collect residual toner remaining on the plurality of image bearing bodies at a single, common place.

In order to attain the above and other objects, the present invention provides an image forming apparatus comprising: a first image bearing member that is capable of bearing a toner image on its surface, the first image bearing member moving to convey the toner image from a developing portion to a first transfer position; a second image bearing member that is capable of bearing a toner image on its surface, the second image bearing member receiving the toner image transferred from the first image bearing member at the first transfer position and moving to convey the toner image to a second transfer position; a transfer unit transferring the toner image from the second image bearing member to an image recording medium at the second transfer position; a first cleaning unit removing, from the first image bearing member, residual toner that remains on the first image bearing member after the toner image is transferred to the second image bearing member, the first cleaning unit discharging the removed toner onto the second image bearing member; and a second cleaning unit removing, from the second image bearing member, residual toner that remains on the second image bearing member after the toner image is transferred from the second image bearing member to the image recording medium, the second cleaning unit removing, from the second image bearing member, the toner discharged from the first cleaning unit.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENT

Figure 1:
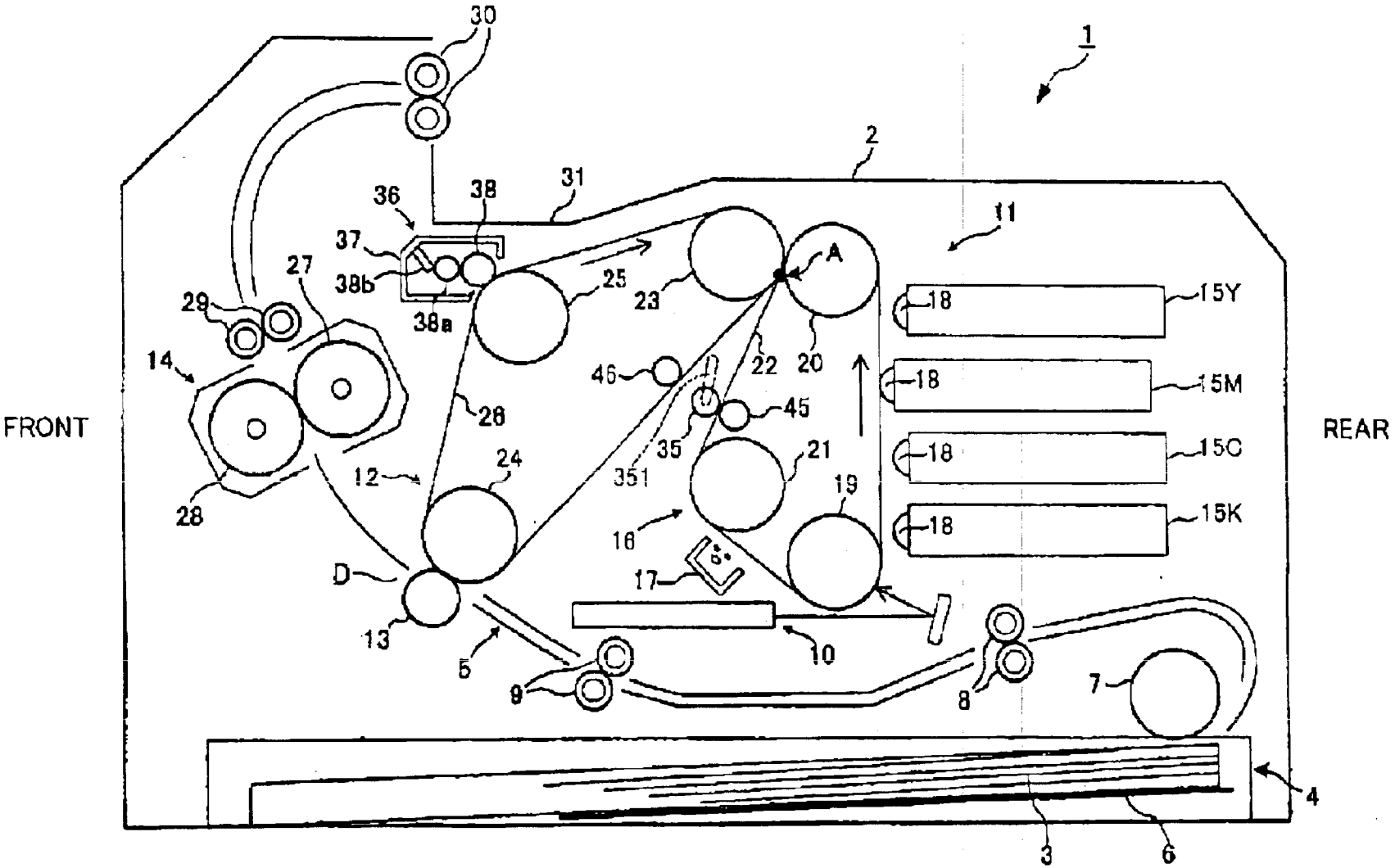
FIG. 1 schematically shows the mechanical construction of a color laser printer according to an embodiment of the present invention.

An image forming apparatus according to a preferred embodiment of the present invention will be described while referring to the accompanying drawings wherein like parts and components are designated by the same reference numerals to avoid duplicating description.

FIG. 1 schematically shows the mechanical construction of a color laser printer 1 (image forming apparatus) according to the embodiment of the present invention.

As shown in FIG. 1, the color laser printer 1 has a main casing 2. Within the main casing 2, a sheet feeding portion 4 and an image forming portion 5 are provided.

The sheet feeding portion 4 is for feeding a sheet of paper 3 (image recording medium). The sheet feeding portion 4 includes: a feed tray 6, a feed roller 7, transport rollers 8, and registration rollers 9. The feed tray 6 holds a stack of sheets 3. Rotation of the feed roller 7 pulls one sheet 3 at a time from the top of the stack. The sheet is then transported to the image forming portion 5 by the transport rollers 8 and the registration rollers 9.

The image forming portion 5 is for forming a desired image on the sheet of paper 3. The image forming portion 5 includes: a scanner unit 10, a process portion 11, an intermediate transferring belt mechanism portion 12, a transferring roller 13, and a fixing portion 14. The process unit 11 includes: four developing cartridges 15 (15Y, 15M, 15C, and 15K), a photosensitive belt mechanism portion 16, and a scorotron type charger 17.

The scanner unit 10 is for forming a latent image on a photosensitive belt 22 (described later), which is provided in the photosensitive belt mechanism portion 16. The scanner unit 10 is provided in the center portion of the main casing 2. The scanner unit 10 includes: a laser light-emitting portion, a polygon mirror, a plurality of lenses, and a plurality of reflection mirrors (not shown in the drawings) In the scanner unit 10, the laser light-emitting portion emits a laser beam modulated based on image data. The laser beam passes through the lenses, is reflected by the polygon mirror, and is reflected by the reflection mirrors, thereby performing high-speed scanning of the surface of the photosensitive belt 22.

The four developing cartridges 15 are provided on the rear side of the main casing 2. The four developing cartridges 15 are: a yellow developing cartridge 15Y for supplying toner in yellow, a magenta developing cartridge 15M for supplying toner in magenta, a cyan developing cartridge 15C for supplying toner in cyan, and a black developing cartridge 15K for supplying toner in black. These developing cartridges 15 are aligned vertically and separated at predetermined distances from one another.

Each developing cartridge 15 includes a developing roller 18, and although not shown in the drawings, a layer thickness regulating blade, a supply roller, and a toner holding portion. A developing cartridge drive portion 57 (shown in FIG. 2) moves the developing cartridges 15Y, 15M, 15C, and 15K horizontally to selectively bring the developing rollers 18 of the developing cartridges 15Y, 15M, 15C, and 15K into and out of contact with the surface of the photosensitive belt 22.

Figure 2:
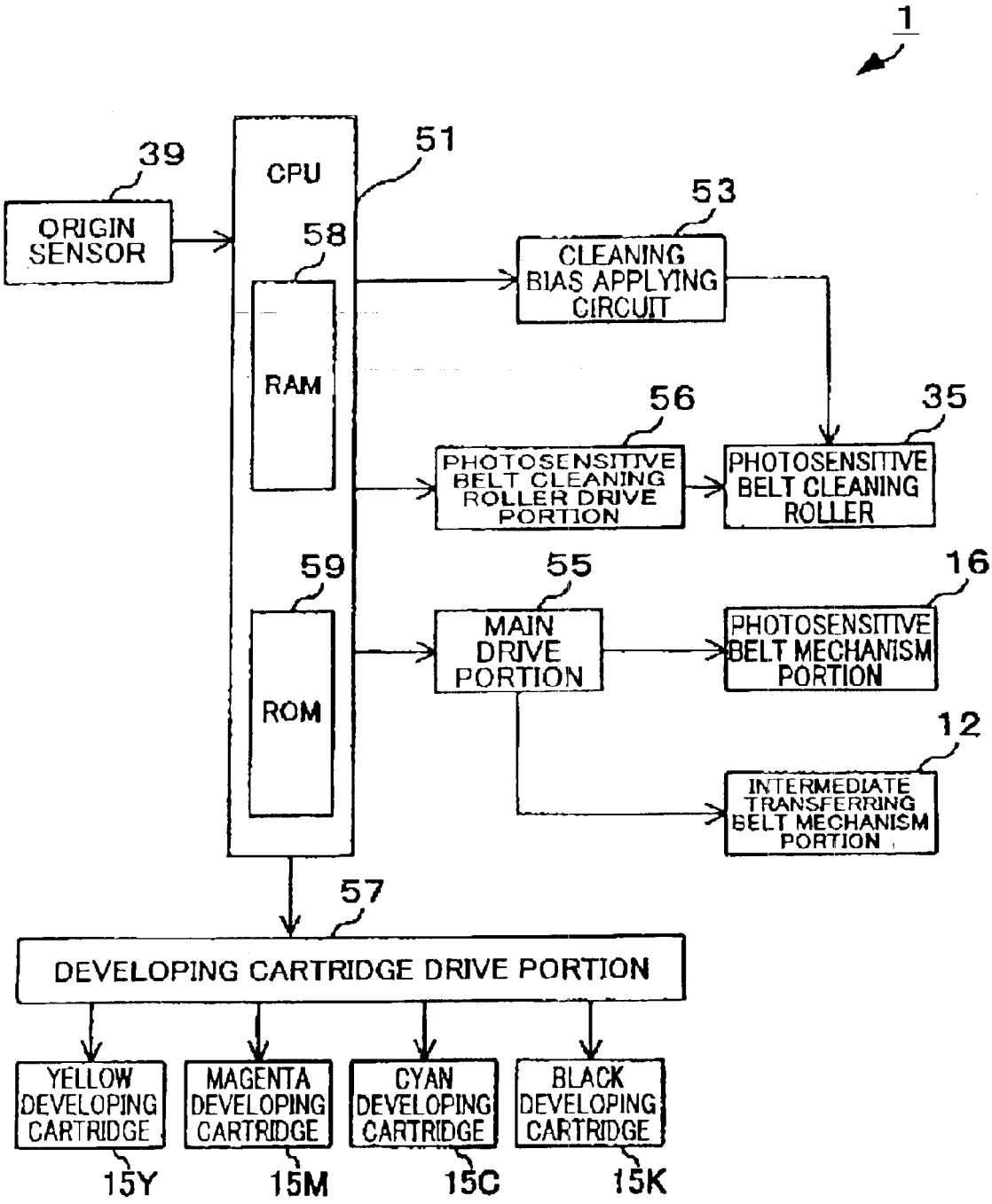
FIG. 2 schematically shows the electric construction of the color laser printer of FIG. 1.

As shown in FIG. 2, the developing cartridge drive portion 57 operates in accordance with a control signal supplied from a CPU 51. The developing cartridge drive portion 57 includes a motor and a clutch mechanism (not shown in the drawing). The yellow developing cartridge 15Y, the magenta developing cartridge 15M, the cyan developing cartridge 15C, and the black developing cartridge 15K are coupled to the developing cartridge drive portion 57. With the motor and clutch mechanism, each developing cartridge 15 (15Y, 15M, 15C, or 15K) is switchably moved between a developing position and a standby position. At the developing position, the developing cartridge 15 is in contact with or is set close to the photosensitive belt 22 and performs development using the toner held in the developing cartridge 15. At the standby position, the developing cartridge 15 is spaced from the photosensitive belt 22 and is in a standby state.

Each of the developing cartridges 15Y, 15M, 15C, and 15K operates in substantially the same manner. That is, the toner holding portion holds non-magnetic one-component polymerized toner (developing agent) in one of colors of yellow, magenta, cyan, and black. The toner has an electrically positive charging property. Rotation of the supply roller supplies the toner housed in the toner holding portion to the developing roller 18, and the layer thickness regulating blade regulates the thickness of the toner on the developing roller. Simultaneously, the toner is positively charged to friction between the toner and the developing roller 18 and the layer thickness regulating blade. Accordingly, a thin layer of toner having a predetermined thickness is borne on the developing roller 18 through an electrostatic force.

The photosensitive belt mechanism portion 16 is disposed in front of the four developing cartridges 15 in confrontation with the four developing cartridges 15. The photosensitive belt mechanism portion 16 includes: a first photosensitive belt roller 19, a second photosensitive belt roller 20, a third photosensitive belt roller 21, and the photosensitive belt 22.

The first photosensitive belt roller 19 is disposed in substantial confrontation with the black developing cartridge 15K, which is at the lowest position in the stack of developing cartridges. The second photosensitive belt roller 20 is disposed vertically above the first photosensitive belt roller 19 in substantial confrontation with the yellow developing cartridge 11Y, which is at the highest position in the stack of developing cartridges. The third photosensitive belt roller 21 is disposed diagonally above the first photosensitive belt roller 19 and diagonally below the second photosensitive belt roller 20. In this way, the photosensitive belt rollers 19 to 21 are disposed in a triangular arrangement.

The photosensitive belt 22 (first image bearing body) is an endless belt. The endless belt 22 is made of a resin, such as polyethylene terephthalate, (PET), with its outer side surface being vapor deposited with aluminum. An organic photosensitive layer is provided on the outer surface of the aluminum deposition layer.

The photosensitive belt 22 is wound around the photosensitive belt rollers 19, 20, to 21. That is, the photosensitive belt 22 is mounted so that the inner side surface of endless belt 22 is in contact with the outer peripheral surfaces of the photosensitive belt rollers 19 to 21.

As shown in FIG. 2, a main drive portion 55 operates in accordance with a control signal supplied from the CPU 51. The main drive portion 55 is provided with a main motor (not shown). The second photosensitive belt roller 20 is coupled to the main motor through a train of gears (not shown). The rollers 19 and 21 are coupled to the roller 20 by the endless belt 22. Accordingly, when the main drive portion 55 drives the main motor to rotate the second photosensitive belt roller 20 in the counterclockwise direction in FIG. 1, the first photosensitive belt roller 19 and the third photosensitive belt roller 21 rotate in the counterclockwise direction by following the rotational driving, with the photosensitive belt 22 rotating around the photo effective belt rollers 19 to 21 in the counter clockwise directions.

It is noted that other several portions are coupled to the main motor. Representative examples of the several portions include: a first intermediate transferring belt roller 23 (to be described later) in the intermediate transferring belt mechanism portion 12; a drive portion (not shown) for driving the feed roller 7, a drive portion (not shown) for driving the transferring roller 13, a drive portion (not shown) for driving an intermediate transferring belt cleaning unit 36 (to be described later).

Although not shown in the drawing, the photosensitive belt 22 is formed with a sensing opening at one end in the widthwise direction of the belt 22. The sensing opening has an approximately rectangular shape, and is formed through the photosensitive belt 22 in its thickness direction to be opened on both of the inner and outer side surfaces. The sensing opening is detected by an origin sensor 39 (FIG. 2).

Figure 3:
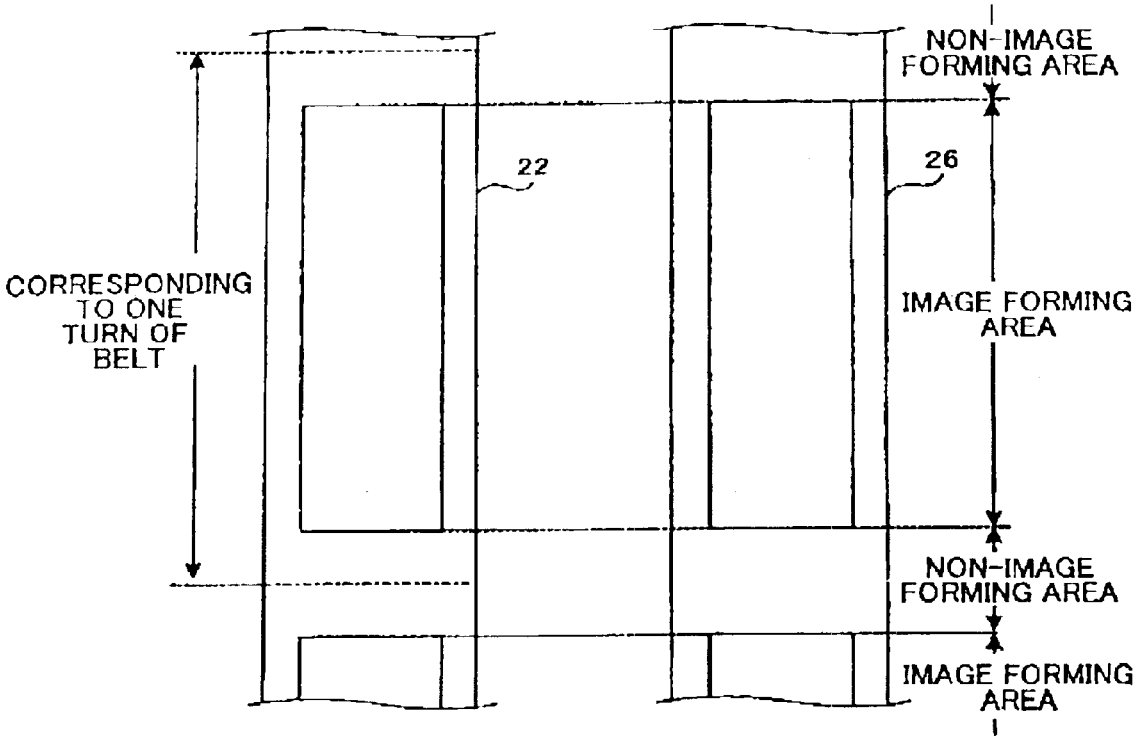
FIG. 3 shows image forming areas and non-image forming areas defined on a photosensitive belt and an intermediate transferring belt.

Although not shown in FIG. 1, the origin sensor 39 is disposed in confrontation with the photosensitive belt 22 at a location between the second photosensitive belt roller 20 and the third photosensitive belt roller 21. The origin sensor 39 includes a light-emitting portion and a light-receiving portion that are disposed in confrontation with each other with the photosensitive belt 22 being located therebetween. The origin sensor 39 sends a detection signal to the CPU 51 when the sensing opening opposes the origin sensor 39 as a result of movement of the photosensitive belt 22 and the light-receiving portion receives light from the light-emitting portion. With reference to the timing when the origin sensor 39 detects the sensing opening, an image forming area and a non-image forming area are defined on the outer side surface of the photosensitive belt 22 as shown in FIG. 3. On the image forming area, the scanner unit 10 will form an electrostatic latent image for one color component, which will then be developed into a toner image by toner supplied from a corresponding developing cartridge 15. On the non-image forming area, no electrostatic latent image will be formed or no toner image will be developed.

The scorotoron type charger 17 includes a charge wire, made from tungsten for example, that generates a corona discharge to charge the surface of the photosensitive belt 22 to a uniform positive charge. The scorotoron type charger 17 is disposed below the photosensitive belt mechanism portion 16 at a position between the third photosensitive belt roller 21 and the first photosensitive belt roller 19 and separated from the photosensitive belt 22 by a predetermined distance.

It is noted that the scorotron type charger 17 charges the surface of the photosensitive belt 22 as a preprocess of the exposure process operations by the scanner unit 10.

The intermediate transferring belt mechanism portion 12 is disposed to the front of the photosensitive belt mechanism portion 16, and includes a first intermediate transferring belt roller 23, a second intermediate transferring belt roller 24, a third intermediate transferring belt roller 25, and an intermediate transferring belt 26.

The first intermediate transferring belt roller 23 is disposed in substantial confrontation with the second photosensitive belt roller 20 via the photosensitive belt 22 and the intermediate transferring belt 26. The second intermediate transferring belt roller 24 is disposed to the front of and below the first intermediate transferring belt roller 23. The third intermediate transferring belt roller 25 is disposed above the second intermediate transferring belt roller 24 and below and to the front of the first intermediate transferring belt roller 23.

The intermediate transferring belt 26 (second image bearing body) is an endless belt made from an electrically-conductive resin, such as polyamide or polycarbonate dispersed with conductive particles such as carbon. The intermediate transferring belt 26 is wound around the intermediate transferring belt rollers 23 to 25.

As described already, the first intermediate transferring belt roller 23 is coupled to the main motor. (not shown)in the main drive portion 55 through another train of gears (not shown) The rollers 24 and 25 are coupled to the roller 23 by the endless belt 26 Accordingly, when the main drive portion 55 (FIG. 2) drives the main motor to rotate the first intermediate transferring belt roller 23 in the clockwise direction in FIG. 1, the second intermediate transferring belt roller 24 and the third intermediate transferring belt roller 25 rotate in the clockwise direction by following the rotational driving, with the belt 26 rotating around the rollers 23 to 25 in the clockwise direction.

It is noted that the main drive portion 55 (FIG. 2) drives the main motor to rotate the second photosensitive belt roller 20 and the first intermediate transferring belt roller 23 to rotate at the same outer peripheral speed so that the photosensitive belt 22 and the intermediate transferring belt 26 move at the same speed.

The outer side surface of the intermediate transferring belt 26 and the outer side surface of the photosensitive belt 22 contact each other at a primary transferring position A, as shown in FIG. 1, and move at the same speed in this contact portion. Accordingly, as shown in FIG. 3, an image forming area and a non-image forming area are defined on the outer side surface of the intermediate transferring belt 26 in correspondence with the image forming area and the non-image forming area defined on the outer side surface of the photosensitive belt 22. A toner image will be transferred from the image forming area of the belt 22 onto the image forming area of the intermediate transferring belt 26. No toner image will be formed on the non-image forming area.

The transferring roller 13 is for performing a transferring operation to transfer the toner image on the image forming area of the intermediate transferring belt 26 onto a sheet of paper 3. The transferring roller 13 confronts against the second intermediate transferring belt roller 24 with the intermediate transferring belt 26 being located therebetween. The transferring roller 13 is moved between a secondary transferring position D and a standby position. At the transferring position D, the transferring roller 13 is in contact with the outer side surface of the belt 26. At the standby position, the transferring roller 13 is spaced from the belt 26. In order to transfer a toner image from the belt 26 onto a sheet of paper 3, the transferring roller 13 is moved from the standby position to the transfer position D. As a result, the transferring roller 13 is brought into contact with the intermediate transferring belt 26. When the sheet of paper 3 teaches the position between the transferring roller 13 and the intermediate transferring belt 26, the transferring roller 13 is applied with a predetermined secondary transferring bias voltage, so that a predetermined electric potential difference is established between the transferring roller 13 and the intermediate transferring belt 26. As a result, the toner image formed on the intermediate transferring belt 26 is transferred onto the sheet 3 that is passing between the intermediate transferring belt 26 and the transferring roller 13.

It is noted that various methods other than the roller 13 can be employed to transfer the color image from the belt 26 to the sheet of paper 3.

With the above-described configuration, the color laser printer 1 performs image forming operation as described below.

The surface of the photosensitive belt 22 is evenly and positively charged by the scorotron type charger 17, before being exposed through high-speed scanning by a laser beam that is emitted from the scanner unit 10 and that is modulated according to image data for one color. In this manner, an electrostatic latent image is formed in the image forming area based on the image data. One developing cartridge 15 holding toner of a corresponding color is moved to the developing position, while the remaining three developing cartridges 15 are still in the standby position. The image forming area of the photosensitive belt 22, which is now formed with the electrostatic latent image, is brought into contact with the developing roller 18 in the corresponding developing cartridge 15. Accordingly, toner of the corresponding color is transferred from the developing cartridge 15 to the image forming area of the photosensitive belt 22. In this way, the electrostatic latent image is developed into a visible toner image of the corresponding color.

When the image forming area of the belt 22, on which the toner image is formed, reaches the primary transferring position A, the image forming area of the belt 26 also reaches the transferring position A. Accordingly, the image forming area of the belt 26 is brought into contact with the image forming area of the belt 22. A predetermined primary transferring bias voltage is applied to the intermediate transferring belt 26 at a timing when the image forming areas of the belts 22 and 26 reach the primary transferring position A. More specifically, although not shown in the drawing, a brushtype or a roller-type electrode is provided at a location near to the roller 23 for applying the primary transferring bias voltage to the belt 26. The primary transferring bias voltage establishes an electric potential difference between the belts 22 and 26 so that the positively-charged toner image will be transferred from the photosensitive belt 22 to the intermediate transferring belt 26. This transfer operation will be referred to a "primary transfer" hereinafter. In this way, the visible image in the single color is transferred onto the image forming area of the intermediate transferring belt 26. It is noted that a primary transferring voltage may be applied to the roller 23 instead of to the belt 26.

The photosensitive belt 22 is further rotated and is subjected to cleaning by a photosensitive belt cleaning roller 35 to be described later. After being electrically discharged by a well-known electrical discharger (not shown), the photosensitive belt 22 is charged again by the charger 17. Following this, an electrostatic latent image for the next color component is formed and developed by the next developing device 15. The visible image is then transferred to the image forming area of the belt 26 at the transfer position A. As a result, this visible image is superimposed on the visible image previously transferred onto the intermediated transferring belt 26. By repeating this processing for the four colors, a final, multicolor image is formed on the intermediate transferring belt 26. It is noted that the electric potential of the photosensitive belt 22 changes at its positions where the photosensitive belt 22 is subjected to the charging process, to the development process, and to the primary transferring process.

Until the multicolor image is finally formed on the belt 26, the transferring roller 13 is continuously in the standby state even when the image forming area of the belt 26 passes between the rollers 13 and 24. After the final, multicolor image is formed in the image forming area of the belt 26, the roller 13 is moved to the secondary transferring position D. When the image forming area of the belt 26 and the sheet of paper passes between the rollers 13 and 24, the roller 13 is applied with the predetermined secondary transfer bias voltage. As a result, the multicolor image is transferred onto the sheet of paper 3. It is noted that the electric potential of the belt 26 changes at its positions where the belt 26 is subjected to the primary transferring process, the secondary transferring process, and the cleaning process (to be described later) executed by the intermediate transferring belt cleaning unit 36).

The fixing portion 14 is disposed to the front of the intermediate transfer belt mechanism portion 12 and at a position downstream in the sheet transport direction from the secondary transferring position D. The fixing portion 15 includes a thermal roller 27, a pressing roller 28, and a pair of transporting rollers 29. The thermal roller 27 has an internal metal layer and an external silicone rubber layer. Although not shown in the drawing, a halogen lamp is installed within the thermal roller 27. The halogen lamp is for heating up the metal and silicone rubber layers. The pressing roller 28 presses against the thermal roller 27. The pair of transporting rollers 29 are positioned downstream from the thermal roller 27 and the pressing roller 28 in the transport direction of the sheet 3.

After the transferring roller 13 transfers the multicolor image onto a sheet 3, the sheet 3 passes between the thermal roller 27 and the pressing roller 28 so that the multicolor image is thermally fixed onto the sheet 3.

The sheet 3 with the thermally-fixed multicolor image is then transported toward a pair of sheet discharging rollers 30 by the transporting rollers 29, and is further delivered by the sheet discharging rollers 30 onto a sheet discharging tray 31, which is formed in an upper portion of the main casing 2.

According to the present embodiment, the photosensitive belt cleaning roller 35 is provided for collecting residual toner that remains on the surface of the photosensitive belt 22 after the toner image is transferred from the photosensitive belt 22 onto the intermediate transferring belt 26.

The photosensitive belt cleaning roller 35 is for performing cleaning operation of the surface of the photosensitive belt 22. The photosensitive belt cleaning roller 35 is disposed on one side opposite to the developing cartridges 15 with respect to the photosensitive belt mechanism portion 16. The photosensitive belt cleaning roller 35 is disposed at a location between the second and third photosensitive belt rollers 20 and 21 and close to the third photosensitive belt roller 21.

The photosensitive belt cleaning roller 35 is a rotary member which has a roller axis and an outer peripheral portion, which is provided around the roller axis. The outer peripheral portion is made of a resilient material, such as silicone rubber, that is capable of capturing toner.

The photosensitive belt cleaning roller 35 is rotatably supported in the main casing 2. The photosensitive belt cleaning roller 35 is movable so as to be brought into contact with and separated from the photosensitive belt 22 and the intermediate transferring belt 26. More specifically, the photosensitive belt cleaning roller 35 is movable between a first position shown in FIG. 4A and a second position shown in FIG. 4B. When the roller 35 is located at the first position, the outer peripheral portion of the roller 35 is in contact with the photosensitive belt 22 at a contact position B. When the roller 35 is located at the second position, the outer peripheral portion of the roller 35 is in contact with the intermediate transferring belt 26 at a contact position C. In this way, the roller 35 is in contact with a selected one of the belts 22 and 35.

Figure 4A:
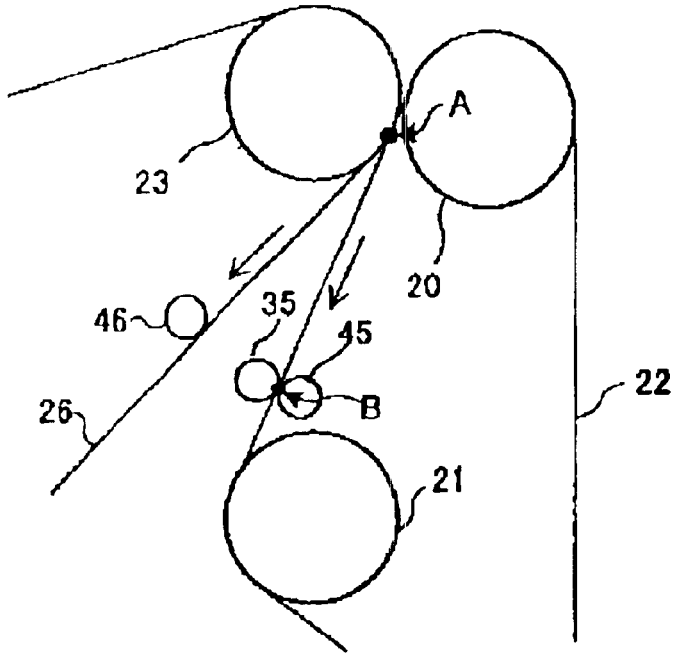
FIG. 4A shows a state where a photosensitive belt cleaning roller contacts the photosensitive belt.
Figure 4B:
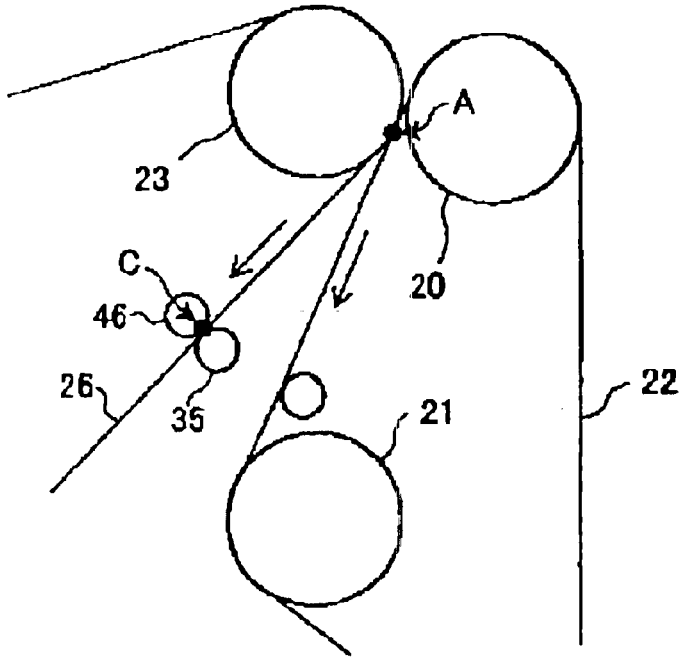
FIG. 4B shows a state where the photosensitive belt cleaning roller contacts the intermediate transferring belt.

A photosensitive belt cleaning roller drive portion 56 is provided as shown in FIG. 2 to drive the photosensitive belt cleaning roller 35 to rotate and to move the photosensitive belt cleaning roller 35 between the first position of FIG. 4A and the second position of FIG. 4B. The photosensitive belt cleaning roller drive portion 56 operates in accordance with a control signal supplied from the CPU 51. Although not shown in the drawings, the photosensitive belt cleaning roller drive portion 56 includes a cam mechanism and a cleaning roller drive motor. The cam mechanism is for moving the photosensitive belt cleaning roller 35 in either one of the first and second positions of FIGS. 4A and 4B. The cleaning roller drive motor is for applying a driving force to the roller axis of the roller 35 and to the cam mechanism.

In the present embodiment, as shown in FIG. 1, a switching member 351 is provided in the main casing 2 so as to be capable of being rocked by the cam mechanism. The cleaning roller drive motor is fixed to a free end portion of the switching member 351, The cleaning roller 35 is connected to an output axis of the cleaning roller drive motor, while being electrically insulated therefrom. In this way, the roller 35 is mounted on the free end portion of the switching member 351 together with the cleaning roller drive motor. Rocking of the switching member 351 moves the cleaning roller 35 between the first and second positions shown in FIGS. 4A and 4B. Accordingly, the cleaning roller 35 is brought into contact with a selected one of the belts 22 and 26, while being separated from the non-selected one.

It is noted that according to the present embodiment, the contact/separation mechanism for bringing the roller 35 into contact with and out of contact with the belts 22 and 26 employs the switching member 351. However, other various configurations can be employed as the contact/separation mechanism.

As shown in FIG. 2, a cleaning bias applying circuit 53 is provided to apply the cleaning roller 35 with first and second cleaning bias voltages While the cleaning roller 35 is in contact with the photosensitive belt 22, the cleaning bias applying circuit 53 applies the roller 35 with the first cleaning bias voltage, which is lower than the electric potential of the belt 22 at the contact position B by a first electric potential difference. Accordingly, the first electric potential difference is established between the cleaning roller 35 and the belt 22 so that the positively-charged toner will be electrostatically attracted in a direction from the photosensitive belt 22 to the roller 35.

As shown in FIG. 4A, while the cleaning roller 35 is in contact with the photosensitive belt 22, the cleaning roller drive portion 56 drives the cleaning roller 35 to rotate in a clockwise direction of FIG. 4A, while the cleaning bias applying circuit 53 applies the first cleaning bias voltage to the roller 35 to transfer residual toner remaining on the photosensitive belt 22 onto the cleaning roller 35. Because the roller 35 rotates in the clockwise direction, a portion of the cleaning roller 35 that is contact with the belt 22 moves in the same direction with a portion of the belt 22 that is contact with the cleaning roller 35.

While the cleaning roller 35 is in contact with the photosensitive belt 22, the photosensitive belt cleaning roller drive portion 56 drives the roller 35 to rotate in a speed different from the belt 22. In this way, according to the present embodiment, the photosensitive belt cleaning roller drive portion 56 applies the cleaning roller 35 with a rotational driving force so that the portion of the roller 35 that contacts with the belt 22 moves in a speed different from the portion of the belt 22 that contacts with the roller 35. Thus, a speed difference occurs between the contact portions of the belt 22 and the roller 35. Even in the case where no speed difference occurs, the roller 35 can perform cleaning of the photosensitive belt 22. However, generating the speed difference applies an external force to the residual toner on the photosensitive belt 22. The external force increases the effect of cleaning by the cleaning bias voltage. It is noted that the roller 35 may rotate faster than the belt 22. Or otherwise, the roller 35 may rotate slower than the belt 22.

A first auxiliary roller 45 is provided at a position so that the roller 45 confronts the photosensitive belt cleaning roller 35 with the photosensitive belt 22 being located therebetween. When the cleaning roller 35 is in contact with the belt 22, the belt 22 is sandwiched between the rollers 35 and 45. The first auxiliary roller 45 has a roller axis covered with a roller portion. The roller axis is made of metal. The roller portion has a hardness that is approximately equal to or less than that of the cleaning roller 35. For example, the roller portion is made of a foam member such as urethane foam. The first auxiliary roller 45 is disposed at such a position that the roller 45 can press the photosensitive belt 22 from a side opposite to the cleaning roller 35 when the cleaning roller 35 contacts the photosensitive belt 22. That is, as shown in FIG. 4A, when the cleaning roller 35 contacts the photosensitive belt 22, the cleaning roller 35 presses the belt 22 rightwardly, while the first auxiliary roller 45 presses the belt 22 leftwardly.

If no auxiliary roller 45 were provided; pressing of the cleaning roller 35 will possibly elongate the belt 22, and the elongated belt 22 will be loosened. According to the present embodiment, however, the belt 22 is sandwiched between the rollers 35 and 45 when the roller 35 is in contact with the belt 22. Accordingly, the belt 22 is pressed by the rollers 35 and 45 in opposite directions. The belt 22 is prevented from being elongated or loosened. It is ensured that the belt is maintained as being properly taut.

While the cleaning roller 35 is in contact with the intermediate transferring belt 26, the cleaning bias applying circuit 53 applies the roller 35 with the second cleaning bias voltage, which is higher than the electric potential of the belt 26 at the contact position C by a second electric potential difference. Accordingly, the second electric potential difference is established between the cleaning roller 35 and the belt 26 so that the positively-charged toner will be electrostatically attracted in a direction from the roller 35 to the belt 26.

As shown in FIG. 4B, while the cleaning roller 35 is in contact with the intermediate transferring belt 26, the cleaning roller drive portion 56 drives the cleaning roller 35 to rotate in a counterclockwise direction of FIG. 4B, while the cleaning bias applying circuit 53 applies the second cleaning bias voltage to the roller 35 to transfer residual toner remaining on the cleaning roller 35 onto the belt 26 Because the roller 35 rotates in the counterclockwise direction, a portion of the cleaning roller 35 that is contact with the belt 26 moves in the same direction with a portion of the belt 26 that is contact with the cleaning roller 35.

A second auxiliary roller 46 is provided at a position so that the roller 46 confronts the photosensitive belt cleaning roller 35 with the intermediate transferring belt 26 being located therebetween. When the cleaning roller 35 is in contact with the belt 26, the belt 26 is sandwiched between the rollers 35 and 46. The second auxiliary roller 46 has the same configuration with the first auxiliary roller 45. The second auxiliary roller 46 is disposed at such a position that the roller 46 can press the belt 26 from a side opposite to the cleaning roller 35 when the cleaning roller 35 contacts the belt 26. Accordingly, when the roller 35 is in contact with the belt 26, the belt 26 is sandwiched between the rollers 35 and 46 and the belt 26 is pressed by the rollers 35 and 45 in opposite directions. In this way, the belt 26 is prevented from being elongated or loosened in the same manner as the belt 22.

As shown in FIGS. 4A and 4B, a length on the photosensitive belt 22 from the transferring position A to the contact position B is approximately equal to a length on the intermediate transferring belt 26 from the transferring position A to the contact position C.

As shown in FIG. 1, the intermediate transferring belt cleaning unit 36 is provided for collecting residual toner that remains on the surface of the intermediate transferring belt 26 after the multicolor toner image is transferred onto the sheet 3.

The intermediate transfer belt cleaning apparatus 36 is for cleaning the intermediate transfer belt 26. The intermediate transfer belt cleaning apparatus 36 is disposed in front of the intermediate transferring mechanism portion 12, and in confrontation with the third intermediate transferring belt roller 25 though the intermediate transferring belt 26.

The intermediate transferring belt cleaning unit 36 includes: an intermediate transferring belt cleaning box 37, an intermediate transferring belt cleaning roller 38, a secondary intermediate transferring belt cleaning roller 38*a*, and an intermediate transferring belt cleaning blade 38*b*.

The intermediate transferring belt cleaning box 37 has a box shape formed with an opening at the side in confrontation with the intermediate transferring belt 26. The space at the bottom of the intermediate transferring belt cleaning box 61 forms a waste toner accumulation portion for accumulating toner that is scraped off by the intermediate transferring belt cleaning blade 38*b*.

The intermediate transferring belt cleaning roller 38 includes a metal core covered with an outer peripheral portion made of a resilient material such as a silicone rubber. The intermediate transferring belt cleaning roller 38 is rotatably supported at the opening of the intermediate transferring belt cleaning box 37 at a position in confrontation with the third intermediate transferring belt roller 25. The intermediate transferring belt cleaning roller 38 is driven by a predetermined drive portion (not shown) to move between a position at which the roller 38 is in contact with the belt 26 and another position at which the roller 38 is out of contact with the belt 26. When the roller 38 is in contact with the belt 26, the outer peripheral portion of the roller 38 contacts the surface of the belt 26 at its side that is opposite to the side where the roller 25 contacts the belt 26. The secondary intermediate transferring belt cleaning roller 38*a* is a metal roller. The intermediate transferring belt cleaning blade 38*b* is made of a resilient material such as urethane.

The intermediate transferring belt cleaning roller 38 is being out of contact with the intermediate transferring belt 26 by a predetermined distance until the multicolor image (superimposed four-color toner images) is finally formed on the intermediate transferring belt 26 when the final, multicolor image is formed on the intermediate transferring belt 26 and transferred from the belt 26 onto the sheet 3, the intermediate transferring belt cleaning roller 38 is brought into contact with the intermediate transferring belt 26. Another cleaning bias voltage is applied to the intermediate transferring belt cleaning roller 38 to establish an electric potential difference between the belt 26 and the roller 38 so that the positively-charged residual toner will be electrostatically attracted in a direction from the belt 26 to the cleaning roller 38.

After the multicolor image is transferred onto the sheet 3, the residual toner remaining on the intermediate transferring belt 26 is conveyed according to the rotation of the intermediate transferring belt 26. When the residual toner reaches the position where the toner confronts the cleaning roller 38, the toner is removed by the cleaning roller 38. According to rotation of the intermediate transferring belt cleaning roller 38, the removed toner is conveyed to the position where the toner confronts the cleaning roller 38*a* The toner is then captured by the cleaning roller 38*a*. After that, the toner captured by the cleaning roller 38*a* is scraped off by the intermediate transferring belt cleaning blade 38*b* and is accumulated in the waste toner accumulating portion.

As shown in FIG. 2, the origin sensor 39, the main drive portion 55, the photosensitive belt cleaning roller drive portion 56, the cleaning bias applying circuit 53, and the developing cartridge drive portion 57 are connected to the CPU 51.

The CPU 51 includes a RAM 58 and a ROM 59. The CPU 51 is for controlling the entire portions of the color laser printer 1. The RAM 58 is for temporarily storing image data. The ROM 59 previously stores: a control program for controlling the cleaning bias applying circuit 53, the main drive portion 55, the developing cartridge drive portion 57, and other control programs.

The cleaning bias applying circuit 53 is for generating the first and second cleaning bias voltages. The roller axis of the photosensitive belt cleaning roller 35 is electrically connected to the cleaning bias applying circuit 53. The cleaning bias applying circuit 53 applies the first and second bias voltages to the photosensitive belt cleaning roller 35 through the roller axis. The ON/OFF timings of the first and second bias voltages and the values of the first and second bias voltages (ON-bias voltages) are controlled by control signals supplied from the CPU 51 to the cleaning bias applying circuit 53.

When the photosensitive belt cleaning roller 35 is in contact with the photosensitive belt 22 at position B as shown in FIG. 4A, the cleaning bias applying circuit 53 applies the roller 35 with the first cleaning bias voltage that establishes the first electric potential difference between the roller 35 and the belt 22, with the potential of the roller 35 being lower than that of the belt 22. In this way, the bias is applied between the roller 35 and the belt 22 in a direction in which the positively-charge toner will be transferred from the belt 22 to the roller 35.

When the photosensitive belt cleaning roller 35 is in contact with the intermediate transferring belt 26 at position C as shown in FIG. 4B, the cleaning bias applying circuit 53 applies the roller 35 with the second cleaning bias voltage that establishes the second electric potential difference between the roller 35 and the belt 26, with the potential of the roller 35 being higher than that of the belt 26. In this way, the bias is applied between the roller 35 and the belt 26 in a direction in which the positively-charged toner will be transferred from the roller 35 to the belt 26.

While the toner image of each color is being formed on the photosensitive belt 22, the roller 35 is in the first contact position B. After the toner image of one color formed on the image forming area of the belt 22 is transferred to the belt 26 at the transfer position A, according to the movement of the belt 22, the residual toner remaining on the image forming area is conveyed to the position B where the toner confronts the roller 35. At the position B, the residual toner is transferred from the belt 22 onto the roller 35.

After toner images of all the four colors are transferred from the belt 22 to the belt 26 and their residual toners are captured by the roller 35, the roller 35 is moved from the first position of FIG. 4A to the second position of FIG. 4B, wherein the roller 35 is brought into contact with the belt 26 at the contact position C. More specifically, after the image forming area of the belt 22 formed with the toner image of the fourth color passes between the rollers 20 and 23, the image forming area of the belt 22 with the residual toner remaining thereon passes between the rollers 35 and 45. When the image forming area of the belt 22 completely passes between the rollers 35 and 45 and the leading edge of the non-image forming area of the belt 22 reaches the position B between the rollers 35 and 45, the roller 35 is moved from the first position of FIG. 4A to the second position of FIG. 4B. As a result, the roller 35, which is now bearing thereon residual toner of all the four colors, is brought into contact with the belt 26 at the contact position C At this time, the leading edge of the non-image forming area of the belt 26 reaches the position C because the length of the belt 22 between the positions A and B is substantially equal to the length of the belt 26 between the positions A and C and because the belts 22 and 26 move with the same speeds. Accordingly, the residual toner of four colors now loaded on the roller 35 is properly transferred to the non-image forming area of the belt 26. The roller 35 is in the second position of FIG. 4B for a while, and moves back to the first position of FIG. 4A before the image forming area of the belt 26 reaches the position between the rollers 35 and 46. In this way, it is possible to discharge, onto the non-image forming area of the belt 26, residual toner of all the colors which has been temporarily captured on the roller 35.

Figure 5:
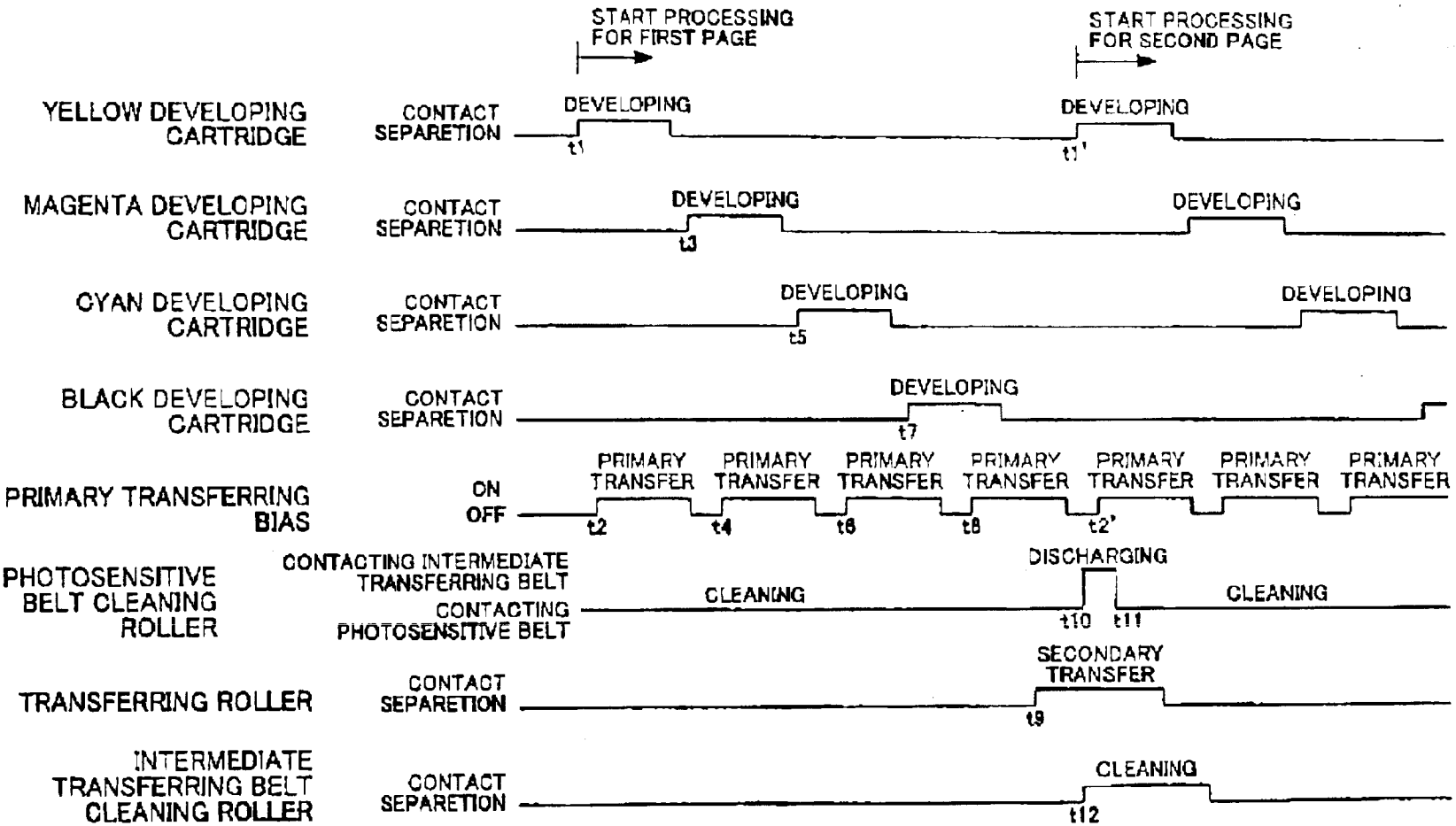
FIG. 5 is a time chart showing an operation in the case where toner is discharged from the photosensitive belt cleaning roller to the intermediate transferring belt while a print operation is being executed.

In the color laser printer 1 with the above-described configuration, a multicolor image is formed on the sheet 3 in a manner shown in FIG. 5.

First, an electrostatic latent image for yellow color component is formed on the photosensitive belt 22 by the scanner unit 10, The yellow developing cartridge 15Y is moved frontward in the horizontal direction by the developing cartridge drive portion 57, thereby letting the developing roller 16 of the yellow developing cartridge 15Y contact the image forming area of the photosensitive belt 22, on which the electrostatic latent image for yellow color has been formed. During this operation, the remaining developing cartridges 15 are moved backward in the horizontal direction by the developing cartridge drive portion 57, thereby spacing the remaining developing rollers 18 from the photosensitive belt 22. In this way, a visible image in yellow is formed in the image forming area of the photosensitive belt 22 only by the yellow toner contained in the yellow developing cartridge 15Y (t1).

Then, by applying a primary transferring bias between the photosensitive belt 22 and the intermediate transferring belt 26, the yellow visible image is transferred onto the image forming area of the intermediate transferring belt 26 when the yellow visible image reaches the transferring position A as a result of movement of the photosensitive belt 22 (t2).

Next, when an electrostatic latent image for magenta color is formed again on the photosensitive belt 22, the magenta developing cartridge 15M is moved frontward in the horizontal direction by the developing cartridge drive portion 57, thereby forming a visible image in magenta in the image forming area of the photosensitive belt 22 (t3).

Then, in the same manner as described above, by applying a primary transferring bias between the photosensitive belt 22 and the intermediate transferring belt 26, the magenta visible image is transferred onto the image forming area of the intermediate transferring belt 26 when the magenta visible image reaches the transferring position A as a result of movement of the photosensitive belt 22 (t4). The yellow toner image has already been transferred onto the image forming area of the intermediate transferring belt 26, so that the magenta visible image is superimposed on the yellow visible image.

The same processing as described above is repeated with the cyan toner held in the cyan developing cartridge 15C and the black toner held in the black developing cartridge 15K. As a result, four-color toner images for one page are superimposed one on another in the image forming area of the intermediate transferring belt 26, and a multicolor image is formed (t5 to t8).

Then, the multicolor image in the image forming area of the intermediate transferring belt 26 is collectively transferred, in a secondary transfer operation, onto the sheet 3 passing between the intermediate transferring belt 26 and the transferring roller 13 while the transferring roller 13 is contacting the intermediate transferring belt 26 and the secondary transferring bias is being applied between the rollers 13 and 26 (t9).

During the development of the visible images on the photosensitive belt 22 (t1, t3, t5, and t7) and the primary transferring of the visible images onto the intermediate transferring belt 26 (t2, t4, t6, and t8), the photosensitive belt cleaning roller 35 is placed by the photosensitive belt cleaning roller drive portion 56 in a state where the photosensitive belt cleaning roller 35 contacts the photosensitive belt 22 and the photosensitive belt 22 is sandwiched between the photosensitive belt cleaning roller 35 and the first auxiliary roller 45. Thus, the photosensitive belt cleaning roller 35 contacts the photosensitive belt 22 during a period, in which the toner images for one page (respective toner images separately formed with the yellow toner, the magenta toner, the cyan toner, and the black toner) are successively borne on the photosensitive belt 22.

While the roller 35 is thus being in contact with the photosensitive belt 22, the cleaning bias applying circuit 53 applies the first cleaning bias to the roller 35 to establish the first potential difference between the belt 22 and the roller 35 in a direction in which the toner on the photosensitive belt 22 is transferred from the photosensitive belt 22 onto the photosensitive belt cleaning roller 35. Thus, residual toner, which remains on the image forming area of the photosensitive belt 22 after the toner image of each color is transferred onto the intermediate transferring belt 26, is captured by the photosensitive belt cleaning roller 35 when the residual toner reaches the position where the toner opposes the photosensitive belt cleaning roller 35 as a result of improvement of the photosensitive belt 22.

Each time a period, required by the photosensitive belt 22 to produce the toner images for one page and to transfer the toner images onto the belt 26, is ended, the image forming area of the photosensitive belt 22 passes between the photosensitive belt cleaning roller 35 and the first auxiliary roller 45 as a result of the circular movement of the photosensitive belt 22. At this timing, the photosensitive belt cleaning roller 35 is spaced from the photosensitive belt 22 by the photosensitive belt cleaning roller drive portion 56 and is moved to the intermediate transferring belt 26 side (t10). As a result, the photosensitive belt cleaning roller 35 is placed in a state where the photosensitive belt cleaning roller 35 contacts the non-image forming area of the intermediate transferring belt 26, with the intermediate transferring belt 26 being sandwiched between the photosensitive belt cleaning roller 35 and the second auxiliary roller 46.

Simultaneously, the cleaning bias applying circuit 53 applies the second cleaning bias to the roller 35 to establish the second potential difference between the roller 35 and the belt 26 in a direction in which the toner on the photosensitive belt cleaning roller 35 is transferred onto the intermediate transferring belt 26. As a result of this processing the toner captured by the photosensitive belt cleaning roller 35 is discharged to the non-image forming area of the intermediate transferring belt 26 with efficiency.

The photosensitive belt cleaning roller 35 is spaced from the intermediate transferring belt 26 and is moved back to the photosensitive belt 22 side (t11) before the image forming area of the intermediate transferring belt 26 reaches the position between the photosensitive belt cleaning roller 35 and the second auxiliary roller 46 according to the movement of the intermediate transferring belt 26. As a result, the photosensitive belt cleaning roller 35 is placed again in a state where the roller 35 contacts the image forming area of the photosensitive belt 22, with the photosensitive belt 22 being sandwiched between the roller 35 and the first auxiliary roller 45. Accordingly, as shown in FIG. 5, it is possible to perform the cleaning of the image forming area of the photosensitive belt 22 even in the case where toner image development (t1') and primary transferring (t2') for the next page are started without waiting for the photosensitive belt 22 to make one rotation but immediately after development for one page (t7) is finished.

After the secondary transferring is started (t9), the intermediate transferring belt cleaning roller 38 is placed in a state here the roller 38 contacts the intermediate transferring belt 26 and the cleaning bias is applied to the roller 38 to establish the electric potential difference between the roller 38 and the intermediate transferring belt 26 (t12). Thus, residual toner, which remains on the image forming area of the intermediate transferring belt 26 after the multicolor image is transferred onto the sheet 3, is captured by the intermediate transferring belt cleaning roller 38 when the residual toner reaches the position where the toner opposes the intermediate transferring belt cleaning roller 38 as a result of rotation of the intermediate transferring belt 26.

Toner discharged from the photosensitive belt cleaning roller 35 onto the non-image forming area of the intermediate transferring belt 26 is also captured by the intermediate transferring belt cleaning roller 38 when the toner reaches the position where the toner opposes the intermediate transferring belt cleaning roller 38 as a result of rotation of the intermediate transferring belt 26. Thus, residual toner remaining on the photosensitive belt 22 is also collected in the intermediate transferring belt cleaning box 37 of the intermediate transferring belt cleaning unit 36.

As described above, in the color laser printer 1 of the present embodiment, the photosensitive belt 22 bears thereon a toner image and conveys the toner image to the primary transferring position A. At the primary transferring position A, the toner image is transferred from the photosensitive belt 22 to the intermediate transferring belt 26. The intermediate transferring belt 26 conveys the toner image to the secondary transferring position D. At the secondary transferring position D, the toner image is transferred to the image recording medium 3. The photosensitive belt cleaning roller 35 is provided to remove residual toner that remains on the photosensitive belt 22 after the toner image is transferred to the intermediate transferring belt 26 at the primary transferring position A. The intermediate transferring belt cleaning unit 36 is provided to remove residual toner that is remained on the intermediate transferring belt 26 after the toner image is transferred to the image recording medium 3 at the secondary transferring position D. The photosensitive belt cleaning roller 35 is constructed to discharge the removed residual toner onto the intermediate transferring belt 26. Accordingly, the residual toner on the photosensitive belt 22 is first removed by the photosensitive belt cleaning roller 35, is discharged from the photosensitive belt cleaning roller 35 onto the intermediate transferring belt 26, and is then finally removed from the intermediate transferring belt 26 by the intermediate transferring belt cleaning unit 36. Accordingly, it is possible to efficiently collect residual toner remaining on the first and second image bearing bodies 22 and 26 into the single, common place 36.

In this way, the photosensitive belt 22 and the intermediate transferring belt 26 are provided so as to be capable of bearing toner images thereon and circularly moving to convey the toner images. The photosensitive belt cleaning roller 35 removes residual toner remaining on the photosensitive belt 22. The intermediate transferring belt cleaning unit 36 removes residual toner remaining on the intermediate transferring belt 26. Toner is discharged from the photosensitive belt cleaning roller 35 onto the intermediate transferring belt 26.

Accordingly, toner on the photosensitive belt 22 is removed by the photosensitive belt cleaning roller 35, is then discharged from the photosensitive belt cleaning roller 35 onto the intermediate transferring belt 26, and is further removed from the intermediate transferring belt 26 by the intermediate transferring belt cleaning unit 36. It is possible to efficiently collect residual toner residing both on the photosensitive belt 22 and on the intermediate transferring belt 26 at a single, common place.

The photosensitive belt cleaning roller 35 is brought into contact with the image forming area of the photosensitive belt 22, thereby capturing residual toner on the photosensitive belt 22. The photosensitive belt cleaning roller 35 is brought into contact with the non-image forming area of the intermediate transferring belt 26, thereby discharging residual toner onto the non-image forming area.

With this construction, it becomes possible to prevent a situation wherein the discharging of residual toner exerts an influence on a toner image borne on the intermediate transferring belt 26. Also, even while the intermediate transferring belt 26 is beating a toner image in its image forming area, it is possible to discharge residual toner from the photosensitive belt cleaning roller 35 onto the intermediate transferring belt 26. Even while the color laser printer 1 is performing a print operation, it is possible to restore the toner removing function of the photosensitive belt cleaning roller 35. It is possible to perform cleaning of the photosensitive belt 22 in an efficient manner.

The first cleaning bias voltage is applied to the roller 35 to establish the first potential difference between the roller 35 and the belt 22. It is possible to perform the removal of toner from the photosensitive belt 22 to the roller 35 in an efficient manner. The second cleaning bias voltage is applied to the roller 35 to establish the second potential difference between the roller 35 and the belt 26. It is possible to perform the discharging of toner from the photosensitive belt cleaning roller 35 onto the intermediate transferring belt 26 in an efficient manner.

The photosensitive belt cleaning roller drive portion 56 controls the photosensitive belt cleaning roller 35 to selectively contact either of the photosensitive belt 22 and the intermediate transferring belt 26. The length on the photosensitive belt 22 from the transferring position A to the contact position B is set approximately equal to the length on the intermediate transferring belt 26 from the transferring position A to the contact position C. It is possible to control the photosensitive belt cleaning roller 35 to contact the image forming area of the photosensitive belt 22 and to contact the non-image forming area of the intermediate transferring belt 26.

The photosensitive belt cleaning roller drive portion 56 controls the photosensitive belt cleaning roller 35 to contact the photosensitive belt 22 for a period of time, required by the photosensitive belt 22 to bear and convey toner images for one page, and to contact the intermediate transferring belt 26 each time after the period is ended. It is possible to discharge toner accumulated on the photosensitive belt cleaning roller 35 to the intermediate transferring belt 26 everytime after the photosensitive belt 22 is used to form an image for one page. It is possible to restore the toner removing function of the photosensitive belt cleaning roller 35 and to efficiently perform cleaning of the photosensitive belt 22.

The photosensitive belt cleaning roller 35 is a rotary member that is capable of rotating, that is capable of capturing toner from the photosensitive belt 22 while contacting the belt 22 at its outer peripheral portion, and that is capable of discharging toner to the intermediate transferring belt 26 while contacting the belt 26 at its outer peripheral portion. It is possible to capture toner using the entire portion of the outer peripheral portion by rotating the photosensitive belt cleaning roller 35. It is possible to efficiently perform the removal of toner from the photosensitive belt 22. It is possible to discharge toner from the entire portion of the outer peripheral portion by rotating the photosensitive belt cleaning roller 35 It is possible to efficiently perform the discharging of toner to the belt 26.

Especially, according to the present embodiment, the outer peripheral portion of the photosensitive belt cleaning roller 35 is made of a resilient material. Accordingly, when the photosensitive belt cleaning roller 35 is pressed against the photosensitive belt 22, it is possible to widen the nip portion (contact surface) of the roller 35 and to efficiently perform the removal of toner from the photosensitive belt 22. A contact pressure (pressing force exerted by the photosensitive belt cleaning roller 35 onto the photosensitive belt 22) that is required to widen the nip portion can be reduced. Even when the photosensitive belt cleaning roller 35 is brought into contact with and is separated from the belt 22, it is possible to suppress the fluctuation of the moving speed of the belt 22.

Because the outer peripheral portion of the roller 35 is made of a resilient material, when the roller 35 is pressed against the belt 26, it is possible to widen the nip portion (contact surface) of the roller 35 and to efficiently perform the discharging of toner onto the belt 26. A contact pressure (pressing force exerted by the photosensitive belt cleaning roller 35 onto the belt 26) that is required to widen the nip portion can be reduced. Even when the cleaning roller 35 is brought into contact with and is separated from the belt 26, it is possible to suppress the fluctuation of the moving speed of the belt 26.

While in contact with the photosensitive belt 22, the photosensitive belt cleaning roller 35 rotates in a direction so that the portion of the roller 35 that contacts with the belt 22 moves in the same direction with the portion of the belt 22 that contacts with the roller 35 while in contact with the belt 26, the photosensitive belt cleaning roller 35 rotates in a direction so that the portion of the roller 35 that contacts with the belt 26 moves in the same direction with the portion of the belt 26 that contacts with the roller 35. It is possible to further reduce the influence exerted by the photosensitive belt cleaning roller 35 onto the moving speeds of the photosensitive belt 22 and the intermediate transferring belt 26.

While the photosensitive belt cleaning roller 35 is in contact with the photosensitive belt 22, the photosensitive belt cleaning roller drive portion 56 rotationally drives the photosensitive belt cleaning roller 35 so that a speed difference occurs in the portion of the cleaning roller 35 contacting the belt 22 and the portion of the belt 22 contacting the roller 35. It is possible to increase a frictional force exerted in the contact portions of the cleaning roller 35 and the belt 22, which makes it possible to perform the removal of toner from the photosensitive belt 22 with more reliability.

The first auxiliary roller 45 is provided at a position that the roller 45 opposes the photosensitive belt cleaning roller 35 with the photosensitive belt 22 being sandwiched between the rollers 35 and 45. It is possible to prevent the photosensitive belt 22 from being loosened by the pressing of the cleaning roller 35 against the photosensitive belt 22. It is possible to suppress an influence exerted on the circular movement speed of the photosensitive belt 22 when the cleaning roller 35 is brought into contact with and out of contact from the photosensitive belt 22.

The second auxiliary roller 46 is provided at a position that the roller 46 opposes the roller 35 with the belt 26 being sandwiched between the rollers 35 and 46 it is possible to prevent the belt 26 from being loosened by the pressing of the cleaning roller 35 against the belt 26. It is possible to suppress an influence exerted on the circular movement speed of the belt 26 when the cleaning roller 35 is brought into contact with and out of contact from the belt 26.

While the invention has been described in detail with reference to the specific embodiment thereof, it would be apparent to those skilled in the art that various changes and modifications may be made therein without departing from the spirit of the invention.

For example, in the embodiment described above, the discharging of residual toner from the photosensitive belt cleaning roller 35 to the intermediate transferring belt 26 is performed each time after a period, during which the photosensitive belt 22 is used to bear toner images for one page, is ended. However, the discharging of residual toner from the roller 35 to the belt 26 may be executed in other various manners. For instance, the photosensitive belt cleaning roller drive portion 56 may control the photosensitive belt cleaning roller 35 to contact the photosensitive belt 22 for a period of time, during which the photosensitive belt 22 is used to bear toner images for a plurality of pages, and to control the photosensitive belt cleaning roller 35 to contact the intermediate transferring belt 26 every time after the period is ended.

In this modification, it is possible to reduce a frequency, at which the photosensitive belt cleaning roller 35 is brought into contact with and out of contact with the photosensitive belt 22. This makes it possible to suppress the occurrence of noise and to decrease the power consumption. It is ensured that no fluctuations will occur in the moving speed of the photosensitive belt 22. It is possible to suppress the occurrence of color misalignment. More specifically, it is possible to suppress the shifts of positions in the respective color images from one another in the final, multicolor image.

In the embodiment described above, when the photosensitive belt cleaning roller 35 contacts the photosensitive belt 22, the photosensitive belt cleaning roller 35 is rotationally driven so that a speed difference causing the portion of the photosensitive belt cleaning roller 35 that contacts the photosensitive belt 22 and the portion of the belt 22 that contacts the roller 35. However, the photosensitive belt cleaning roller 35 may be rotationally driven so that the portion of the photosensitive belt cleaning roller 35 that contacts the photosensitive belt 22 will move at the same speed with the portion of the belt 22 that contacts the roller 35.

For example, the photosensitive belt cleaning roller 35 may be provided to rotate by following the movement of the photosensitive belt 22 while being in contact with the photosensitive belt 22. That is, the roller 35 may be provided to rotate due to the friction generated by the contact between the surface of the roller 35 and the surface of the belt 22. Similarly, the photosensitive belt cleaning roller 35 may rotate by following the movement of the intermediate transferring belt 26 while being in contact with the belt 26. That is, the roller 35 may rotate due to the friction generated by the contact between the surface of the roller 35 and the surface of the belt 26.

The mechanism employed to rotate the cleaning roller 35 can be simplified. It is possible to further reduce fluctuations of a load placed on the belt 22 when the cleaning roller 35 is brought into and out of contact with the belt 22. It is possible to further reduce fluctuations of a load placed on the belt 26 when the cleaning roller 35 is brought into and out of contact with the belt 26. It is possible to further reduce fluctuations of the moving speed of the belt 26.

Figure 6:
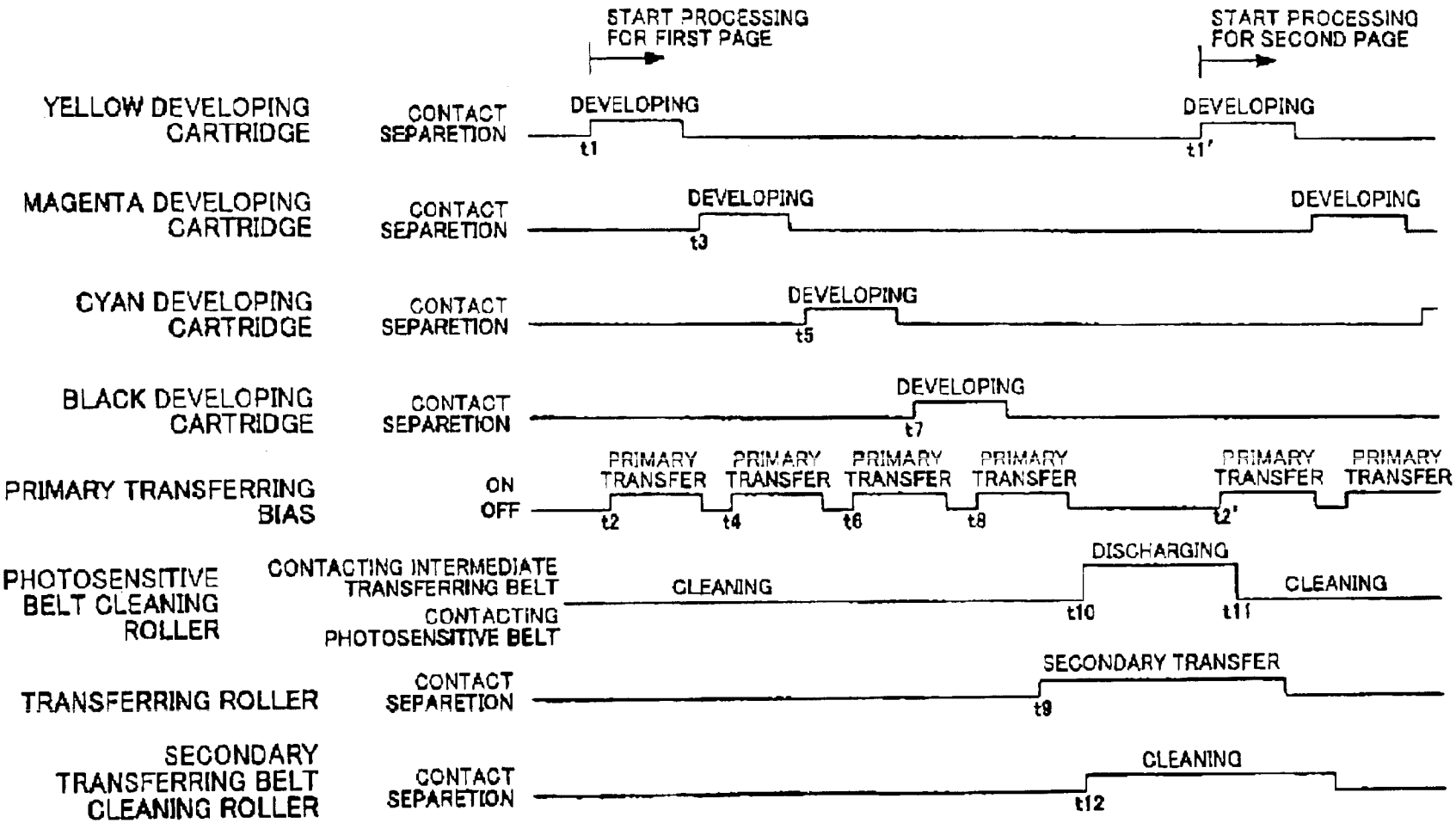
FIG. 6 is a time chart showing an operation in the case where toner is discharged from the photosensitive belt cleaning roller to the intermediate transferring belt while a print operation is being stopped.

In the embodiment described above, residual toner is discharged from the photosensitive belt cleaning roller 35 to the intermediate transferring belt 26 while a print (output) operation is being executed in the color laser printer 1. However, the toner discharging timing may be changed. For example, as shown in FIG. 6, the print operation may be temporarily stopped after all the four color images for one page is transferred from the belt 22 to the belt 26. While the print operation is being stopped, residual toner is discharged from the photosensitive belt cleaning roller 35 to the intermediate transferring belt 26. In this modification, residual toner may be discharged not only onto the non-image forming area but also onto the image forming area of the intermediate transferring belt 26. In the case where the residual toner is discharged onto the image forming area, the transferring roller 13 has to be spaced from the intermediate transferring belt 26 when the image forming area of the belt 26 passes between the rollers 13 and 24 It is possible to prevent the residual toner from being transferred from the intermediate transferring belt 26 to the transferring roller 13.

In the embodiment described above, the cleaning bias applying circuit 53 is supplied with control signals from the CPU 51 Accordingly, the ON/OFF timings of the first and second cleaning bias voltages and the values of the first and second cleaning bias voltages (ON-bias voltages) are controlled by the CPU 51. However, the cleaning bias applying circuit 53 may be modified in various manners.

Figure 7:
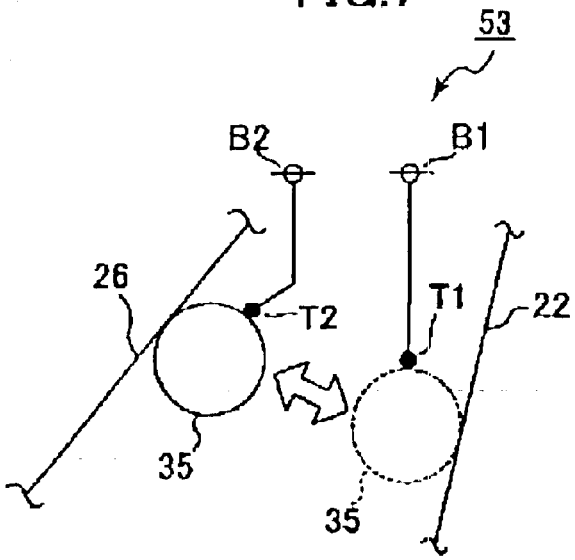
FIG. 7 shows a modification of a cleaning bias applying circuit.

For example, the cleaning bias applying circuit 53 may have a simple configuration as shown in FIG. 7. In this case, the circuit 53 includes a power source B1, a power source B2, a contact terminal T1, and a contact terminal T2. The contact terminal T1 is connected to the power source B1 and is located at a position so that the contact terminal T1 is brought into contact with the roller 35 when the roller 35 is in contact with the belt 22. The power source B1 is for applying the first cleaning bias voltage that is lower than the potential of the belt 22 by the first potential difference. Accordingly, when the roller 35 is in contact with the belt 22, the power source B1 applies the roller 35 with the first cleaning bias voltage to establish the first potential difference between the roller 35 and the belt 22 so as to transfer toner from the belt 22 to the roller 35.

The contact terminal T2 is connected to the power source B2 and is located at another position so that the contact terminal T2 is brought into contact with the roller 35 when the roller 35 is in contact with the belt 26. The power source B2 is for applying the second cleaning bias voltage that is higher than the potential of the belt 26 by the second potential difference. Accordingly, when the roller 35 is in contact with the belt 26, the power source B2 applies the roller 35 with the second cleaning bias voltage to establish the second potential difference between the roller 35 and the belt 26 so as to transfer toner from the roller 35 to the belt 26.

Figure 8:
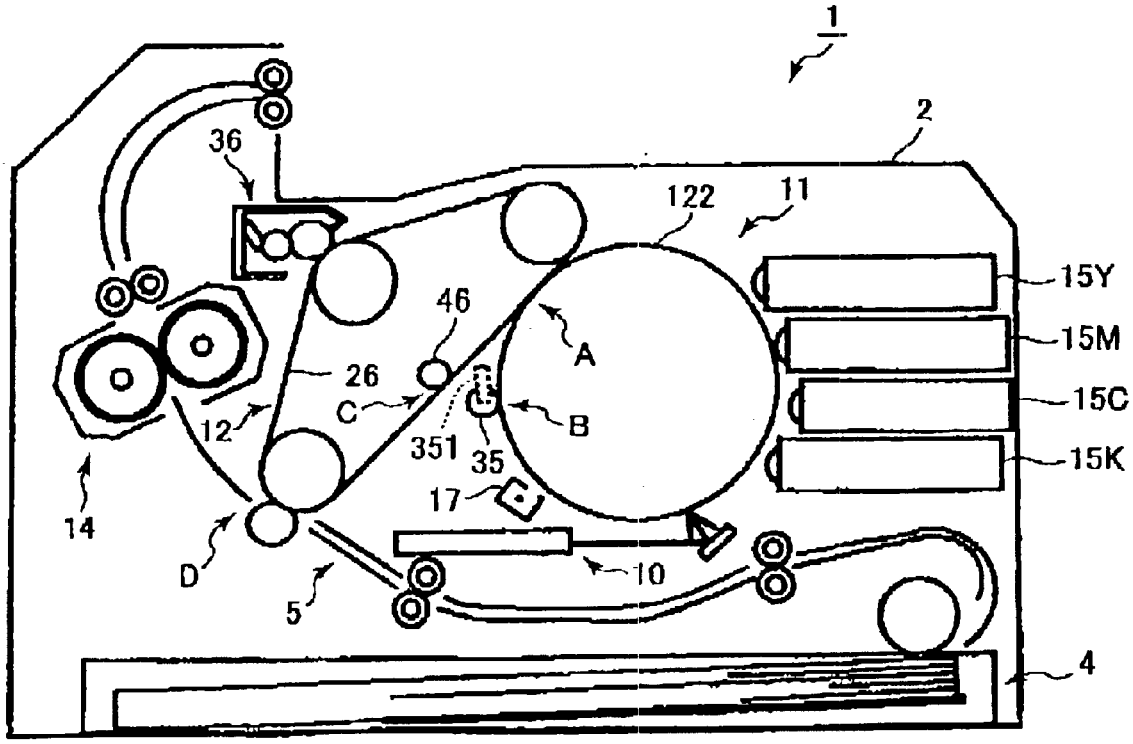
FIG. 8 schematically shows the mechanical construction of a color laser printer according to a modification.

As shown in FIG. 8, the photosensitive belt 22 may be replaced with a photosensitive drum 122. The photosensitive drum 122 has a photosensitive material layer on its outer peripheral surface, on which an electrostatic latent image is formed by the scanner unit 10 and is developed into a toner image by a corresponding developing cartridge 15. The photosensitive drum 122, thus bearing the toner image thereon, rotates around its rotational axis to convey the toner image to the primary transferring position A, at which the toner image is transferred to the belt 26. In this case, the first auxiliary roller 45 becomes unnecessary.

Similarly, although not shown in the drawings, the intermediate transferring belt 26 may be replaced with an intermediate transferring drum, whose outer peripheral surface can receive toner images from the photosensitive belt 22 or the photosensitive drum 122. The intermediate transferring drum can convey the toner images to the secondary transferring position D according to its rotation about its rotational axis. In this case, the second auxiliary roller 46 becomes unnecessary.

The embodiment described above relates to the color laser printer 1. However, the present invention is not limited to the color laser printer, but can be applied to any other types of image forming apparatus so long as the image forming apparatus has a plurality of image bearing bodies.

In the above-described embodiment, the toner is charged positively. Accordingly, the first cleaning bias voltage, applied to the cleaning roller 35 while the roller 35 is in contact with the belt 22, is lower than the electric potential of the belt 22. Because the polarity of the roller 35 relative to the belt 22 is negative, the positively-charged toner can be efficiently transferred from the belt 22 to the roller 35. The second cleaning bias voltage, applied to the roller 35 while the roller 35 is in contact with the belt 26, is higher than the electric potential of the belt 26 Because the polarity of the belt 26 relative to the roller 35 is negative, the positively-charged toner can be efficiently transferred from the roller 35 to the belt 26. However, the toner may be formed of material that is charged negatively. In this case, the first cleaning bias voltage should be set higher than the electric potential of the belt 22. Because the polarity of the roller 35 relative to the belt 22 is positive, the negatively-charged toner can be efficiently transferred from the belt 22 to the roller 35. The second cleaning bias voltage should be set lower than the electric potential of the belt 26. Because the polarity of the belt 260 relative to the roller 35 is positive, the negatively-charged toner can be efficiently transferred from the roller 35 to the belt 26.

What is claimed is:

1. An image forming apparatus comprising:

a first image bearing member that is capable of bearing a toner image on its surface, the first image bearing member moving to convey the toner image from a developing portion to a first transfer position;

a second image bearing member that is capable of bearing a toner image on its surface, the second image bearing member receiving the toner image transferred from the first image bearing member at the first transfer position and moving to convey the toner image to a second transfer position;

a transfer unit transferring the toner image from the second image bearing member to an image recording medium at the second transfer position;

a first cleaning unit removing, from the first image bearing member, residual toner that remains on the first image bearing member after the toner image is transferred to the second image hearing member, the first cleaning unit discharging the removed toner onto the second image bearing member; and a second cleaning unit removing, from the second image bearing member, residual toner that remains on the second image bearing member after the toner image is transferred from the second image bearing member to the image recording medium, the second cleaning unit removing, from the second image bearing member, the toner discharged from the first cleaning unit.

2. An image forming apparatus according to claim 1, wherein the second image bearing member has an image forming area and a non-image forming area on its surface, the second image bearing member receiving the toner image on the image forming area from the first image bearing member, the first cleaning unit discharging the removed toner onto the non-image forming area of the second image bearing member.

3. An image forming apparatus according to claim 1, wherein the residual toner is electrically charged, and wherein the first cleaning unit includes:

a cleaning member receiving the residual toner from the first image bearing member;

a contact/separation mechanism causing the cleaning member to contact the surface of the first image bearing member while being separated from the second image bearing member and causing the cleaning member to contact the surface of the second image bearing member while being separated from the first image bearing member; and a bias voltage applying unit establishing, when the cleaning member contacts the first image bearing member, a first electric potential difference between the first image bearing member and the cleaning member to transfer the electrically-charged residual toner in a direction from the first image bearing member to the cleaning member, the bias voltage applying unit establishing, when the cleaning member contacts the second image bearing member, a second electric potential difference between the cleaning member and the second image bearing member to transfer the electrically-charged residual toner in a direction from the cleaning member to the second image bearing member.

4. An image forming apparatus according to claim 3, wherein the first image bearing member has a first image forming area and a first non-image forming area on its surface, the second image bearing member having a second image forming area and a second non-image forming area on its surface, the second image bearing member receiving the toner image at the second image forming area from the first image forming area of the first image bearing member at the first transfer position, and wherein the contact/separation mechanism causes the cleaning member to contact the first image forming area of the first image bearing member to thereby allow the cleaning member to receive the residual toner that remains on the first image forming area, the contact/separation mechanism causing the cleaning member to contact the second non-image forming area of the second image bearing member to thereby allow the cleaning member to discharge the received toner onto the second non-image forming area.

5. An image fanning apparatus according to claim 4, wherein the surface of the first image bearing member contacts the surface of the second image bearing member at the first transfer position to transfer the toner image from the first image bearing member to the second image bearing member, wherein the contact/separation mechanism causes the cleaning member to contact the surface of the first image bearing member at a toner-removing position on the first image bearing member and to contact the second image bearing member at a toner-discharging position on the second image bearing member, and wherein a length defined on the first image bearing member from the first transfer position to the toner-removing position is approximately equal to a length defined on the second image bearing member from the first transfer position to the toner-discharging position.

6. An image forming apparatus according to claim 5, wherein the contact/separation mechanism causes the cleaning member to contact the first image bearing member for a predetermined time period, required by the first image bearing member to bear thereon a toner image for a predetermined number of pages, the contact/separation mechanism causing the cleaning member to contact the second image bearing member every time the predetermined period of time is elapsed.

7. An image forming apparatus according to claim 6, wherein the predetermined number is equal to one.

8. An image forming apparatus according to claim 6, wherein the predetermined number is greater than one.

9. An image forming apparatus according to claim 3, wherein the cleaning member is a rotary member that has a central axis and an outer peripheral portion around the central axis and that is capable of rotating about the central axis, and wherein the contact/separation mechanism causes the outer peripheral portion of the rotary member to selectively contact the first image bearing member and the second image bearing member.

10. An image forming apparatus according to claim 9, wherein the outer peripheral portion of the rotary member is made of a resilient material.

11. An image forming apparatus according to claim 9, wherein the rotary member rotates, while the contact/separation mechanism causes the rotary member to contact the first image bearing member, in a direction that causes a portion of the outer peripheral portion of the rotary member and a portion of the surface of the first image bearing member that contact with each other to move in the same direction with each other, wherein the rotary member rotates, while the contact/separation mechanism causes the rotary member to contact the second image bearing member, in another direction that causes a portion of the outer peripheral portion of the rotary member and a portion of the surface of the second image bearing member that contact with each other to move in the same direction with each other.

12. An image forming apparatus according to claim 11, further comprising an image-bearing-member driving unit driving the first image bearing member and the second image bearing member to move;

wherein when the contact/separation mechanism causes the rotary member to contact the first image bearing member, the rotary member rotates following the movement of the first image bearing member due to friction generated by the contact between the outer peripheral portion of the rotary member and the surface of the first image bearing member, and wherein when the contact/separation mechanism causes the rotary member to contact the second image bearing member, the rotary member rotates following the movement of the second image bearing member due to friction generated by the contact between the outer peripheral portion of the rotary member and the surface of the second image bearing member.

13. An image forming apparatus according to claim 11, further comprising a rotary-member drive unit driving, when the cleaning member contacts the first image bearing member, the rotary member to rotate at a rotational speed that causes a portion of the outer peripheral portion of the rotary member and a portion of the surface of the first image bearing member that contact with each other to move in the same direction with each other but at different speeds from each other.

14. An image forming apparatus according to claim 3, wherein the first image bearing member includes a first endless belt that is wound around a plurality of first rotational members and that is capable of rotating around the periphery of the plurality of first rotational members, and further comprising a first auxiliary member that is provided at a position to sandwich the first endless belt between the first auxiliary member and the cleaning member when the contact/separation mechanism causes the cleaning member to contact the first endless belt.

15. An image forming apparatus according to claim 3, wherein the second image bearing member includes an endless belt that is wound around a plurality of rotational members and that is capable of rotating around the periphery of the plurality of rotational members, and further comprising an auxiliary member that is provided at a position to sandwich the endless belt between the auxiliary member and the cleaning member when the contact/separation mechanism causes the cleaning member to contact the endless belt.

16. An image forming apparatus according to claim 1, wherein the first image bearing member includes a photosensitive material on its surface, further comprising:

a latent image forming unit that is capable of forming a plurality of latent images for a plurality of different colors on the surface of the first image bearing member; and a plurality of developing units storing toner of the plurality of different colors and developing the plurality of latent images by using the toner into a plurality of toner images of the plurality of colors, wherein the second image bearing member receiving the plurality of toner images at the same position on its surface, the plurality of toner images being superimposed one on another on the surface of the second image bearing member, thereby forming a final multicolor toner image, and wherein the transfer unit transfers the final multicolor toner image onto the image recording medium.

17. An image forming apparatus according to claim 16, wherein the second image bearing member includes an intermediate transfer endless belt that is wound around a plurality of rotational members and that is capable of rotating around the periphery of the plurality of rotational members.

18. An image forming apparatus according to claim 16, wherein the first image bearing member includes a photosensitive endless belt that is wound around a plurality of first rotational members, that has a photosensitive layer on its outer surface, and that is capable of rotating around the periphery of the plurality of first rotational members.

19. An image forming apparatus according to claim 16, wherein the first image bearing member includes a photosensitive drum that is capable of rotating around its rotational axis, and that has a photosensitive layer on its outer peripheral surface.

* * * * *